US005348634A

United States Patent [19]

Matsuo et al.

[11] Patent Number: 5,348,634

[45] Date of Patent: Sep. 20, 1994

[54] METHOD FOR COATING METAL PLATES

[75] Inventors: Katsuhiko Matsuo, Ibaraki; Kuninori Takeshi, Sakai, both of Japan

[73] Assignee: Shinto Paint Co., Ltd., Amagasaki, Japan

[21] Appl. No.: 665,214

[22] Filed: Mar. 5, 1991

[30] Foreign Application Priority Data

Mar. 14, 1990 [JP] Japan ..... 2-63685

[51] Int. Cl.[5] ..... C25D 13/12

[52] U.S. Cl. ..... 204/181.1; 204/180.2; 427/388.1; 427/409

[58] Field of Search ..... 204/181.1, 184.4, 181.7, 204/180.2; 427/388.1, 409

[56] References Cited

U.S. PATENT DOCUMENTS 3,500,399 2/1985 Hart et al. ..... 204/181.1
4,442,019 4/1984 Marks ..... 252/309

FOREIGN PATENT DOCUMENTS 40035 4/1978 Japan ..... 204/181.1
34799 of 1984 Japan .
201488 8/1989 Japan .
1309356 3/1973 United Kingdom .

OTHER PUBLICATIONS

Patent Abstracts of Japan, vol. 2, No. 81 (C-016)[1132], Jun. 28, 1978.

*Primary Examiner*—John Niebling
*Assistant Examiner*—Kishor Mayekar
*Attorney, Agent, or Firm*—Wenderoth, Lind & Ponack

[57] ABSTRACT

The present invention provides a method for coating metal plates by applying an organic coating composition containing 5 to 70% by weight of molybdenum disulfide, to the metal plate, in a dry film thickness of from 0.5 to 20μ, drying the applied composition, and subjecting the coated metal plate to forming processing, and electrodeposition coating.

3 Claims, No Drawings

METHOD FOR COATING METAL PLATES

BACKGROUND OF THE INVENTION

The present invention relates to a coating method for coating metal plates and in particular, to a coating method for coating metal plates exhibiting excellent electrodeposition coating and workability, which comprises coating a sheet steel, a steel article, or a plated article thereof; an aluminum article, a zinc article, or an alloy article thereof; a cold rolled bright sheet steel or an alloy-plated cold rolled bright sheet steel; or the like with an organic coating composition containing molybdenum disulfide alone or molybdenum disulfide in combination with electroconductive fine particles, drying the thus coated sheet steel or article, and then subjecting it to forming processing.

Hitherto, in coating automobile bodies, a method in which a cold rolled dull sheet steel is successively subjected to surface preparation and electrodeposition coating and then finished by applying an intermediate coat and a top coat has been commonly employed. Recently, improvements in smoothness and image clearness of coating films are being keenly demanded. For this purpose, not only paints themselves but smoothness of a substrate have come into question. However, since a cold rolled bright sheet steel which exhibits the highest smoothness among steels does not have holding power for lubricants, it involves problems from the standpoint of processing steps because it likely causes inconveniences such as a phenomenon in which a material to be processed adheres to the surface of a mold to damage the mold, and a phenomenon in which a material to be processed adheres to the surface of a mold during the forming processing. Accordingly, although the cold rolled bright sheet steel is known to be the best steel in order to improve the image clearness, it has not yet been used. Recently, a laser dull sheet steel comprising a sheet steel having provided thereon regular markings has turned up. Through this laser dull sheet steel is admitted to have an effect for improving the sharpness as compared with the cold rolled dull sheet steel, it is still not superior to the cold rolled bright sheet steel.

Furthermore, in organic coating film-applied composite plated sheet steels used in automobile bodies, if a substrate sheet steel is a cold rolled dull sheet steel, it is known that there are involved the same problems in smoothness and image clearness. Still further, in the organic coating film-applied composite plated sheet steels, coating films containing a large quantity of zinc dust such as zincrometal generate problems such as peeling and powdering during the forming processing. Moreover, even in composite coated sheet steels having a 1$\mu$-thick silica-containing organic coating film which has been developed thereafter, since the coating film is electrically insulative, in order to obtain a good property of electrodeposition coating in the electrodeposition coating to be subsequently carried out, the film thickness must be controlled within $1\pm0.3$ microns, whereby a large number of management steps are required for the production so that even a slight dispersion variability of the film thickness results in deterioration of the property of electrodeposition coating. In any of these cases, demands the present status an immediate improvement.

There have been made investigations based on an assumption that in sheet steels for automobile bodies having these defects,if a phenomenon in which a material to be processed adheres to the surface of a mold to damage the mold, and a phenomenon in which a material to be processed adheres to the surface of a mold during the forming processing, could be solved by coating, the problems in smoothness and image clearness of the finishing of a top coat could be solved. As a result, it has become clear that in the case that an organic lubricant is added merely for the purpose of imparting workability, though the workability is improved, there is involved a problem in the property of electrodeposition coating, whereas in the case that a coating composition to which electrical conductivity has been imparted is applied on a sheet steel, though the property of electrodeposition coating is improved, the workability is not improved at all.

SUMMARY OF THE INVENTION

Accordingly, the present inventors thought that if a coating film to be formed on a sheet steel exhibits workability and a property of electrodeposition coating, it becomes possible to use not only usual sheet steels but a cold rolled bright sheet steel so that the smoothness and image clearness of the coating film can be improved. As a result of further investigations, it has been found that a coating film containing from 5 to 70% by weight of molybdenum disulfide exhibits excellent electrodeposition coating within the range of film thickness of from 0.5 to 20$\mu$, and that while molybdenum disulfide is commonly known as a solid lubricant, it exhibits the same effect in said coating film so that high formability comparable to that in a cold rolled dull sheet steel having applied thereon a lubricant is obtained, leading to accomplishment of the present invention.

Furthermore, the molybdenum disulfide-containing coating film applied on a sheet steel which is formed according to the present invention has varistor property and conducts extremely low electrical current at a low voltage so that it exhibits good corrosion resistance and electrodepositive property.

DESCRIPTION OF THE PREFERRED EMBODIMENT

That is, the present invention relates to a coating method for coating metal plates, which comprises applying an organic coating composition on a metal plate without being surface treated or after surface preparation or chromate treatment, in a dry film thickness of from 0.5 to 20$\mu$, drying it, subjecting the coated-metal plate to forming processing, and then conducting electrodeposition coating. More specifically, the present invention relates to a coating method for coating metal plates, which comprises applying an organic coating film containing from 5 to 70% by weight of molybdenum disulfide alone or from 5 to 70% by weight of molybdenum disulfide in combination with electroconductive fine particles on a metal plate without being surface treated or after surface preparation or chromate treatment, drying it, subjecting it to forming processing, and then conducting electrodeposition coating.

As the metal plates which are used in the present invention, various metal plates such as sheet steels, stainless steel sheets, sheet steels plated with Zn alone or alloys (such as ZnNi, ZnFe, and ZnAl), molten Zn-plated sheet steels, aluminum sheets, and duralumin sheets can be used, but it is a great characteristic of the invention that a cold rolled bright sheet steel which has hitherto been unable to be used due to the problem in formability can be used. As the surface preparation to be subsequently carried out, not only a mere cleaning operation but zinc phosphate treatment, iron phosphate treatment, coating type chromate treatment, and the like are preferable because improvements in corrosion resistance and adhesive property are found. In particular, in the case of sheet steels, the zinc phosphate treatment is preferred, whereas in the case of alloy-plated sheer steels, the coating type chromate treatment is preferred. After the surface treatment, an organic coating composition containing from 5 to 70% by weight of molybdenum disulfide is applied in a dry film thickness of from 0.5 to 20μ. The content of molybdenum disulfide in the composition is from 5 to 70% by weight, preferably from 10 to 50% by weight. That is, if the content of molybdenum disulfide is less than 5% by weight, the necessary electrical current does not flow during electrodeposition so that the electrodepositive property during the electrodeposition coating to be carried out later becomes poor, whereas if it exceeds 70% by weight, the physical properties of the coating film tend to be deteriorated. Examples of the electroconductive fine particles which are optionally used in combination with molybdenum disulfide include commonly used electroconductive fine particles such as zinc oxide, tin oxide, electroconductive carbon, graphite, and triiron tetroxide. A suitable amount of the electroconductive fine particles to be used in combination is from 0 to 50% by weight, preferably from 5 to 20% by weight, of the content of molybdenum disulfide. As the addition amount increases, the amount of the electrical current which flows increases, and the film thickness limit of electrodeposition during the electrodeposition coating to be carried out later also increases. However, if it exceeds 50%, the corrosion resistance is lowered. As the resin for dispersing them, any resin which is generally used can be used without particular limitations. Among them, blocked isocyanate curable epoxy resins, melamine curable oil-free polyester resins, melamine curable linear polyester resins, amide curable epoxy resins, melamine curable epoxy resins, melamine curable acrylic resins, blocked isocyanate curable oil-free polyester resins, blocked isocyanate curable oil-free polyester and epoxy mixed resins, blocked isocyanate curable epoxy ester resins, etc. are particularly suitable. Besides, as a matter of course, pigments and additives which are used in usual paints, such as flow control agents (e.g., colloidal silica and bentonite), color pigments, levelling agents, antisag agents, antifoaming agents, dispersing agents, antisettling agents, and antiblocking agents (e.g., polyethylene waxes), can be used within a range wherein the characteristics of the coating film are not deteriorated. The organic coating composition according to the present invention is dispersed together with molybdenum disulfide and electroconductive fine particles in a usual paint dispersing machine such as a ball mill, a steel mill, an attritor, a sand mill, and a roll mill to prepare a milled base which is then added with the resin and additives, etc., followed by adjusting with an organic solvent so as to have a proper viscosity.

As the organic solvent which can be used, aromatic hydrocarbon solvents, aliphatic hydrocarbon solvents, ketone solvents, ester solvents, and ether solvents can be used singly or in admixture without limitations.

The organic coating composition is applied in a dry film thickness of from 0.5 to 20μ, preferably from 1 to 5μ. Any of conventionally employed methods such as roll coater coating, spray coating, and electrostatic finishing can be employed as the coating method, but in a precoated metal, roll coater coating is the most suitable because of the coating speed as veil as uniformity of the dried coating film. In the case that the dry film thickness is less than 0.5μ, an improvement in the corrosion resistance to be brought about by the coating cannot be expected. On the other hand, if it exceeds 20μ, the electrical conductivity is so poor that not only is the electrodepositive property deteriorated, but powdering likely takes place during the forming processing. The coating film is dried or baked under the conditions that the temperature (temperature of an article to be coated) is from room temperature to 300° C., preferably from 20° to 250° C. In particular, in the case of treating a zinc alloy-plated sheet steel with a coating type chromate processing solution, the temperature is preferably in the range of from 100° to 280° C. That is, if the temperature is lower than 100° C., the chemical reaction of the chromate layer is insufficient, the crosslinking rate of the coating film is low, and good corrosion resistance cannot be expected. Further, if the temperature exceeds 250° C., cracks are generated in the chromate coating film, and $Cr^{+6}$ decreases, whereby the corrosion resistance is lowered.

Since the coating film thus formed from the organic coating composition according to the present invention has superior formability and electrodepositive property as described above, the metal plate having formed thereon a coating film can be immediately subjected to forming processing and then electrodeposition coating.

The electrodeposition coating can be carried out in a manner exactly the same as in the usual electrodeposition coating method. That is, the coating can be freely carried out without limitations by anionic electrodeposition, cationic electrodeposition, one-coat acrylic cationic electrodeposition, high bild type electrodeposition, etc. In particular, in coating automobiles, to which the present invention is mainly applied, cationic electrodeposition with a high bild type or low temperature curable cationic electrodeposition paint is the most suitable. At the time of coating, the voltage is from 50 to 400 V, preferably from 80 to 250 V. If the voltage is lower than 50 V, the film thickness is lowered because of the varistor property of the molybdenum disulfide coating film that a sufficient film thickness cannot be obtained. On the other hand, if the voltage exceeds 400 V, there is a fear of occurrence of rupture of the film. Therefore, it is necessary to select a suitable voltage within the above-described range in order to control the film thickness, depending upon the condition of the electrodeposition paint. Though the film thickness is usually suitably about 20μ, it varies with the temperature of the bath solution, the liquid temperature is desirably from 25° to 30° C. more desirably 27°±1° C. Though the time of supply of an electrical current may be varied for the purpose of control of the film thickness in relation with the voltage, it is suitably from 2 to 5 minutes, usually 3 minutes. After electrodeposition under the foregoing conditions, the resulting coating film is washed with water and baked at from 100° to 200° C. for from 20 to 30 minutes to complete production of the coating film. The thus obtained electrodeposition coating film is superior in corrosion resistance, smoothness and overcoatability.

Next, the present invention will be described with reference to the following Examples and Comparative Examples.

A 0.8 mm-thick cold rolled dull sheet steel (JIS G3141 SPCC-SD) and a 0.8 mm-thick cold rolled bright sheet steel were each treated with Bonderite #3020, applied with an organic coating composition of the Example or Comparative Example as shown in Table 1 below by means of a bar coater, and then dried under the prescribed condition. Thereafter, the resulting sheet steel was subjected to forming processing and electrodeposition and then evaluated for formability, property of electrodeposition coating, corrosion resistance, and image clearness of top coat.

The results are shown in Tables 2 and 3. The various conditions in each of the Examples and Comparative Examples are shown below.

(I) Formulation and Production Method of Organic Coating Composition

EXAMPLE 1

| | |
|---|---|
| (1) $MoS_2$ ("Moly Powder PS" made by Sumico Lubricant Co., Ltd.) | 34.2 weight parts |
| (2) $SiO_2$ ("Mizukasil P-526" made by Mizusawa Industrial Chemicals, Ltd.) | 0.5 weight part |
| (3) Epoxy resin ("EP-1009" made by Shell Chemical Co., Ltd.) | 33.5 weight parts |
| (4) Dicyandiamide ("Adeka Hardener HT-2844" made by Asahi Denka Kogyo K.K.) | 0.7 weight part |
| (5) Butyl cellosolve | 35.0 weight parts |
| (6) Methyl ethyl ketone | 49.1 weight parts |
| (7) Dispersing agent | 0.15 weight part |
| Total | 153.15 weight parts |

First of all, the compounding components (3) to (6) were mixed and stirred for dissolution to prepare a resin solution. The compounding components (1), (2) and (7) were then added to a part of the resin solution and stirred. Glass beads were added to the mixture in a sand mill for experimental purposes, dispersed for 45 minutes to one hour, filtered, and then provided for the tests.

EXAMPLES 2 TO 4 AND COMPARATIVE EXAMPLES 1 TO 6

The formulation of each of Examples 2 et seq is shown in Table 1 below. The production methods of Examples 2 to 4 and Comparative Examples 1 to 4 were according to that of Example 1. In Comparative Example 5, zinc dust was incorporated after formation of a varnish.

Further, in Comparative Example 6, a commercially available zincrometal was provided for the tests as it was.

(II) Formability (1) Deep Drawing (limited drawing ratio)

A coating film was provided on one side of a sheet having a size of 0.8×150×150 mm and tested for the limited drawing ratio by flat bottom cylindrical drawing. That is, a disc having a prescribed blank diameter was cut out from a test sheet having a size of 0.8×150×150 mm and subjected to drawing by a punch under a constant sheet holder pressure by means of a cutting hydraulic press. At this time, the limited drawing ratio is calculated in terms of a ratio of the maximum blank diameter at which the drawing-out can be conducted to the diameter of the punch.

$$[\text{Limited drawing ratio}]=a/b$$

In the above-described equation, a means the maximum blank diameter at which the drawing-out can be conducted, and b means the diameter of the punch by which cylindrical drawing is conducted.

(2) Powdering

After forming processing under the following press condition, a powdered peeled coating film attached to a die was taken by a cellophane adhesive tape and observed. At the same time, the surface of the formed article was visually evaluated.

Press Condition

| | |
|---|---|
| Sheet holder pressure: | 1 ton |
| Blank diameter: | 90 mmϕ |
| Punch diameter: | 50 mmϕ |
| Drawing rate: | 5 mm/sec |

Evaluation Standard

A: No powdered peeled coating film is attached to the die and, hence, the coating film is good.

B: A powdered peeled coating film is slightly attached to the die.

C: A powdered peeled coating film is considerably attached to the die, and the coating film is peeled and damaged.

(III) Property of Electrodeposition Coating

A cationic electrodeposition paint, Succed #700 Grade (made by Shinto Paint Co., Ltd.) was adjusted so as to have a solution concentration of 18% by weight, subjected to electrodeposition coating at 28° C. and at 200 V for 3 minutes, and then baked and dried at 170° C. for 20 minutes to obtain a coating film having a film thickness of 20±1μ. The surface appearance was then observed.

The evaluation was made by the following ratings.

A: film thickness uniformity 1μ>, good smoothness

B: film thickness uniformity 2μ>, good smoothness

C: film thickness uniformity 3μ>, slightly inferior smoothness

D: The coating film is non-uniform, the formation of pinholes is observed, and non-coated portions are observed.

(IV) Corrosion Resistance

After coating under the conditions as described in (III) above such that the electrodeposition coating film thickness was 20±1μ, the resulting coating film was provided with cross-cuts and placed in a salt spray chamber (5% NaCl spray, test temperature: 35° C.). Eight hundred and forty hours later, generation of rust in the processed portions (bent at 90° with 10 mmR) and the planar portions was observed.

A: The coating film did not change at all.

B: While the generation of rust was observed in the cross-cut portions, the coating film did not change.

C: A blister with a width of 3 mm was observed in the cross-cut portions, and several blisters were observed in the planar portions.

D: Contamination of rust was considerably observed, and blisters were generated.

E: Generation of blisters and rust was observed on the entire surface.

(V) Image Clearness of Top Coat

After coating under the conditions as described in (III) above such that the electrodeposition coating film thickness was 20±1μ, a white intermediate coat for automobiles, Glymin #100 (made by Shinto Paint Co., Ltd.) was applied in a dry film thickness of 30 to 35μ. The resulting coating film was baked at 140° C. for 20 minutes and, after further applying a white top coat, Glymin #100 (made by Shinto Paint Co., Ltd.) in a dry thickness of 30 to 35μ, was further baked at 140° C. for 20 minutes.

The smoothness of the completed coating film was measured by ICM (image clarity meter) and PGD.

TABLE 1

| Item | Example or Comparative Example No. | | | | |
|---|---|---|---|---|---|
| | Ex. 1 | Ex. 2 | Ex. 3 | Ex. 4 | Com. Ex. 1 |
| $MoS_2$ content (wt %) | 50 | 10 | 47 | 28 | 3 |
| Electroconductive fine particle | | | electro-condutive carbon | graphite | |
| Fine particle content (wt %) | | | 3 | 2 | |
| Resin: | | | | | |
| Epoxy resin ("EP-1009" made by Shell Chemical Co., Ltd.) | 48.1 | 87.3 | 48.1 | | 93.8 |
| Acrylic resin ("Dianal HR-686" made by Mitsubishi Rayon Co., Ltd.) | | | | 48.4 | |
| Hardener: | | | | | |
| Melamine resin ("Sumimal 40S" made by Sumitomo Chemical Co., Ltd.) | | | | 20.7 | |
| Dicyandiamide ("Adeka Hardener HT-2844" made by Asahi Denka Kogyo K.K.) | 1.0 | 1.8 | 1.0 | | 1.9 |
| Pigment dispersing agent | 0.2 | 0.2 | 0.2 | 0.2 | 0.1 |
| $SiO_2$ | 0.7 | 0.7 | 0.7 | 0.7 | 1.2 |

| Item | Example or Comparative Example No. | | | | |
|---|---|---|---|---|---|
| | Com. Ex. 2 | Com. Ex. 3 | Com. Ex. 4 | Com. Ex. 5 | Com. Ex. 6* |
| $MoS_2$ content (wt %) | 80 | 5 | | | |
| Electroconductive fine particle | | electro-conductive zinc oxide | electro-condutive carbon | zinc dust | |
| Fine particle content (wt %) | | 55 | 30 | 80 | |
| Resin: | | | | | |
| Epoxy resin ("EP-1009" made by Shell Chemical Co., Ltd.) | 19.0 | 38.1 | 67.7 | 17.9 | |
| Acrylic resin ("Dianal HR-686" made by Mitsubishi Rayon Co., Ltd.) | | | | | |
| Hardener: | | | | | |
| Melamine resin ("Sumimal 40S" made by Sumitomo Chemical Co., Ltd.) | | | | | |
| Dicyandiamide ("Adeka Hardener HT-2844" made by Asahi Denka Kogyo K.K.) | 0.4 | 1.0 | 1.4 | 1.4 | |
| Pigment dispersing agent | 0.3 | 0.2 | 0.2 | — | |
| $SiO_2$ | 0.3 | 0.7 | 0.7 | 0.7 | |

*Zincrometal was used.

[Note]

i): All weight parts are calculated as the solids content.

ii): In all of the Examples and Comparative Examples, the coating composition was diluted with a solvent (comprising butyl cellosolve, methyl ethyl ketone, and xylene) so as to have a viscosity suitable for the coating and then provided for the tests.

TABLE 2

| | Type of Sheet Steel | Formability | | Image clearness of Top Coat | |
|---|---|---|---|---|---|
| | | Deep Drawing | Powdering | ICM | PGD |
| Example 1 | Dull | 2.24 | A | 68 | 0.8 |
| | Bright | 2.04 | A | 82 | 1.0 |
| Example 2 | Dull | 2.16 | A | 70 | 0.7 |
| | Bright | 2.00 | A | 80 | 1.0 |
| Example 3 | Dull | 2.24 | A | 69 | 0.7 |
| | Bright | 2.10 | A | 78 | 1.0 |
| Example 4 | Dull | 2.16 | A | — | — |
| | Bright | 2.00 | A | — | — |
| Comparative Example 1 | Dull | 2.00 | A | | |
| | Bright | 1.92 | A | | |
| Comparative Example 2 | Dull | 2.44 | C | | |
| | Bright | 2.00 | C | | |
| Comparative Example 3 | Dull | 2.08 | B | | |
| | Bright | 1.94 | B | | |
| Comparative Example 4 | Dull | 1.98 | A | | |
| | Bright | 1.92 | A | | |
| Comparative Example 5 | Dull | 1.98 | C | 66 | 0.6 |
| | Bright | 1.94 | C | 75 | 0.8 |
| Comparative Example 6 | Zincrometal | 2.00 | C | 64 | 0.7 |
| Non-treated cold rolled dull sheet steel | | 2.00 | — | | |
| Non-treated cold rolled bright sheet steel | | 1.92 | — | | |

TABLE 3

| | Film Thickness (μ) | Property of Electrodeposition Coating | Corrosion resistance | |
|---|---|---|---|---|
| | | | Planar Portion | Processed Portion |
| Example 1 | 1 | A | B | B |
| | 5 | A | B | B |
| | 15 | B | B | B |
| Example 2 | 1 | A | B | B |
| | 5 | B | B | B |
| | 15 | B | B | B |
| Example 3 | 1 | A | B | B |
| | 5 | A | B | B |
| | 15 | A | B | B |
| Example 4 | 1 | A | B | B |
| | 5 | A | B | B |
| | 15 | B | B | B |
| Comparative Example 1 | 1 | C | B | B |
| | 5 | D | B | B |
| | 15 | D | B | B |
| Comparative Example 2 | 1 | A | C | D |
| | 5 | A | B | D |
| | 15 | A | B | D |
| Comparative Example 3 | 1 | A | C | D |
| | 5 | B | C | D |
| Comparative Example 4 | 1 | A | C | D |
| | 5 | B | C | D |
| Comparative Example 5 | 1 | A | B | C |
| | 5 | B | B | D |
| Comparative Example 6 | — | A | B | D |

*: The film thickness means a film thickness of the organic coating composition.

According to the coating method of the present invention, it becomes possible to use a cold rolled bright sheet steel which has been considered to be a problem in terms of the formability. Furthermore, since the coating method of the present invention enables conducting electrodeposition on the cold rolled bright sheet steel, a coating film with high image clearness can be obtained. Therefore, the coating method of the present invention is suitable as a coating method for sheet steels for automobiles.

What is claimed is:

1. A coating method for coating a metal plate, which comprises providing an organic coating composition which contains from 5 to 70% by weight of molybdenum disulfide, said composition forming a coating film which has a varistor property, applying the organic coating composition on a metal plate, without being surface treated or after surface preparation or chromate treatment, in a dry film thickness of from 0.5 to 20μ, drying the applied composition to form a coating film which has a varistor property, subjecting the resultant coated metal plate to forming processing, and then conducting electrodeposition coating on the metal plate.

2. A coating method as claimed in claim 1, wherein said metal plate is a non-treated or surface-treated cold rolled bright sheet steel.

3. A coating method as claimed in claim 1, wherein said metal plate is a cold rolled bright sheet steel, the surface of which has been plated with an alloy.

* * * * *